US006074999A

United States Patent [19]

Iizuka et al.

[11] Patent Number: 6,074,999

[45] Date of Patent: Jun. 13, 2000

[54] CLEANING AGENTS FOR PAINT PIPING AND PROCESS FOR CLEANING PAINT PIPING

[75] Inventors: Toshiaki Iizuka, Koshigaya; Youichi Yamada, Tokyo; Tatsumi Yotsugi; Mitsunori Sawai, both of Koshigaya, all of Japan

[73] Assignee: Daishin Chemical Co., Ltd., Tokyo, Japan

[21] Appl. No.: 08/877,352

[22] Filed: Jun. 17, 1997

[30] Foreign Application Priority Data

Dec. 27, 1996 [JP] Japan ..... 8-359912

[51] Int. Cl.[7] ..... C11D 3/28; C11D 3/30; C11D 3/32

[52] U.S. Cl. ..... 510/201; 510/170; 510/175; 510/176; 510/178; 510/182; 510/212; 510/432; 510/407; 510/499; 510/501; 134/38

[58] Field of Search ..... 510/170, 175, 510/176, 178, 182, 201, 212, 432, 501, 499, 407; 134/38

[56] References Cited

U.S. PATENT DOCUMENTS

| | | | |
|---|---|---|---|
| 4,435,717 | 3/1984 | Eida et al. | 346/1.1 |
| 4,770,713 | 9/1988 | Ward | 134/38 |
| 5,102,573 | 4/1992 | Han et al. | 252/153 |
| 5,399,203 | 3/1995 | Ishikawa et al. | 134/10 |
| 5,417,877 | 5/1995 | Ward | 252/153 |
| 5,464,888 | 11/1995 | Owen | 524/104 |
| 5,485,188 | 1/1996 | Tochihara et al. | 347/100 |
| 5,496,491 | 3/1996 | Ward et al. | 252/153 |
| 5,597,678 | 1/1997 | Honda et al. | 430/331 |
| 5,734,403 | 3/1998 | Suga et al. | 347/101 |
| 5,753,601 | 5/1998 | Ward et al. | 510/176 |

FOREIGN PATENT DOCUMENTS

| | | |
|---|---|---|
| 128908 | 4/1973 | Japan . |
| 188311 | 7/1989 | Japan . |
| 68094 | 7/1990 | Japan . |

*Primary Examiner*—Yogendra Gupta
*Assistant Examiner*—Charles Boyer
*Attorney, Agent, or Firm*—Wenderoth, Lind & Ponack, L.L.P.

[57] ABSTRACT

Disclosed is a cleaning agent for cleaning paint piping without disassembling it in reduced number of steps and a process for cleaning the paint piping using the same. A cleaning agent based on N-methyl-2-pyrrolidone and containing an amine type solvent such as dimethylacetamide, ethanolamine, isopropanolamine and triethanolamine and a nonionic surfactant is circulated through the paint piping.

9 Claims, 2 Drawing Sheets

CLEANING AGENTS FOR PAINT PIPING AND PROCESS FOR CLEANING PAINT PIPING

BACKGROUND OF THE INVENTION

1. Field of the Invention

The present invention relates to a cleaning agent for cleaning paint piping employed for coating automotive bodies and the like and a process for cleaning paint piping employing the same.

2. Description of the Related Art

FIGS. 1 and 2 show an example of paint piping employed for coating automotive bodies. A paint or coating is stored in a tank 1. When a hydraulic pump 2 shown in FIG. 1 is driven, the coating is circulated such that it may pass first through a filter 3 and then is pumped through a feed pipe 4 to a main piping 5 to be returned to the tank 1 through a return pipe 6, and a part of the coating in circulation is used for coating automotive bodies.

The main piping 5 is a pipe line for feeding the coating to a coating spot and has on the way branch pipes 7 connected thereto at predetermined intervals, as shown in FIG. 2. Each branch pipe 7 is formed by connecting a plurality of pipe units and has a regulator 12 provided at the middle and a spray gun 8 for injecting the coating attached to the distal end. Further, a sub branch pipe 10 is connected to the branch pipe 7 via a color change valve 9, and this sub branch pipe 10 is connected to a sub piping 11. The sub branch piping 10 is also formed by connecting a plurality of pipe units.

In such paint piping, aggregates of coating materials adhere on the internal wall surface of the piping in a long while. Such coating aggregates not only lower the pressure of injecting a coating but also are injected together with the coating to be deposited on the material to be coated, being causative of defective coating. In order to remove the aggregates, the paint piping must be cleaned.

According to the prior art cleaning process, the coating is extracted from all the members constituting the paint piping including the tank, the main piping, branch pipes, etc., and a cleaning thinner is circulated through the paint piping. However, it is impossible to remove the coating aggregates adhered stiff to the piping merely by circulating the cleaning thinner, and, in this case, the piping is cleaned using a special acidic cleaning agent based on a chlorine-containing solvent.

More specifically, while cleaning of the piping is carried out using an acidic cleaning agent containing a chlorine-containing solvent such as trichloroethylene, methylene chloride, tetrachloroethylene, 1,1,1,2-tetrachloroethylene and 1,1,2,2-tetrachloroethane, the piping must be disassembled to remove attachments such as the branch pipes 7, the sub branch pipes 10, the regulators 12 and the valves 9, since these attachments are difficult to clean. Accordingly, the pipe units constituting the main piping 5 having a large diameter are recombined into a form of straight pipe, and then a cleaning agent containing a chlorine-containing solvent is circulated through it and through the tank 1 to clean them.

The cleaning procedures employing such cleaning agent containing a chlorine-containing solvent are typically carried out as follows:

(1) A cleaning agent containing a chlorine-containing solvent at a high concentration of 80 to 90 wt % is circulated to clean the straight pipe and the tank;

(2) The cleaning agent is extracted and is replaced with isopropyl alcohol (IPA) by circulating it;

(3) A cleaning agent containing about 20 wt % of chlorine-containing solvent and an anti-corrosive is circulated to remove iron oxides, aluminum, etc.;

(4) An alkaline solution containing sodium hydroxide and a chelating agent dissolved therein is circulated to effect neutralization;

(5) A solution incorporated with a preservative is injected and then extracted;

(6) IPA is circulated to remove moisture;

(7) A cleaning thinner is circulated to remove IPA; and (8) A diluting thinner employed for diluting the coating is circulated to remove the cleaning thinner.

The prior art cleaning process described above involves the following problems:

(1) Since the chlorine-containing solvent is harmful, the cleaning is risky, and the greatest care must be taken in handling the solvent. The solvent if discarded causes environmental disruption;

(2) The cleaning agent has strong acidity and corrodes the pipe, the pipe must be subjected to a reducing treatment, a neutralizing treatment and a preserving treatment after the cleaning procedures, making the post-treatment intricate;

(3) Since a strong acidity solution and a strong alkaline solution are employed, the cleaning procedures involve risks;

(4) Since the paint piping must be disassembled and the pipe units constituting the main piping must be recombined to form a straight pipe prior to cleaning, and since the paint piping must be reassembled after completion of cleaning, the cleaning procedures include many steps and require a long time (80 hours for achieving cleaning of a cleaning volume of 600 liters); and (5) Attachments excluding the main piping such as the branch pipes, the regulators, the color change valves, etc. cannot be cleaned. Accordingly, when the paint piping is reassembled, these attachment members must be replaced with new ones wastefully.

SUMMARY OF THE INVENTION

The present invention is directed to provide a cleaning agent which can solve all the problems involved in cleaning of paint piping according to the prior art and also a process for cleaning paint piping using such cleaning agent.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments taken in conjunction with the attached drawings in which:

DETAILED DESCRIPTION OF THE PREFERRED EMBODIMENTS

Figure 1:
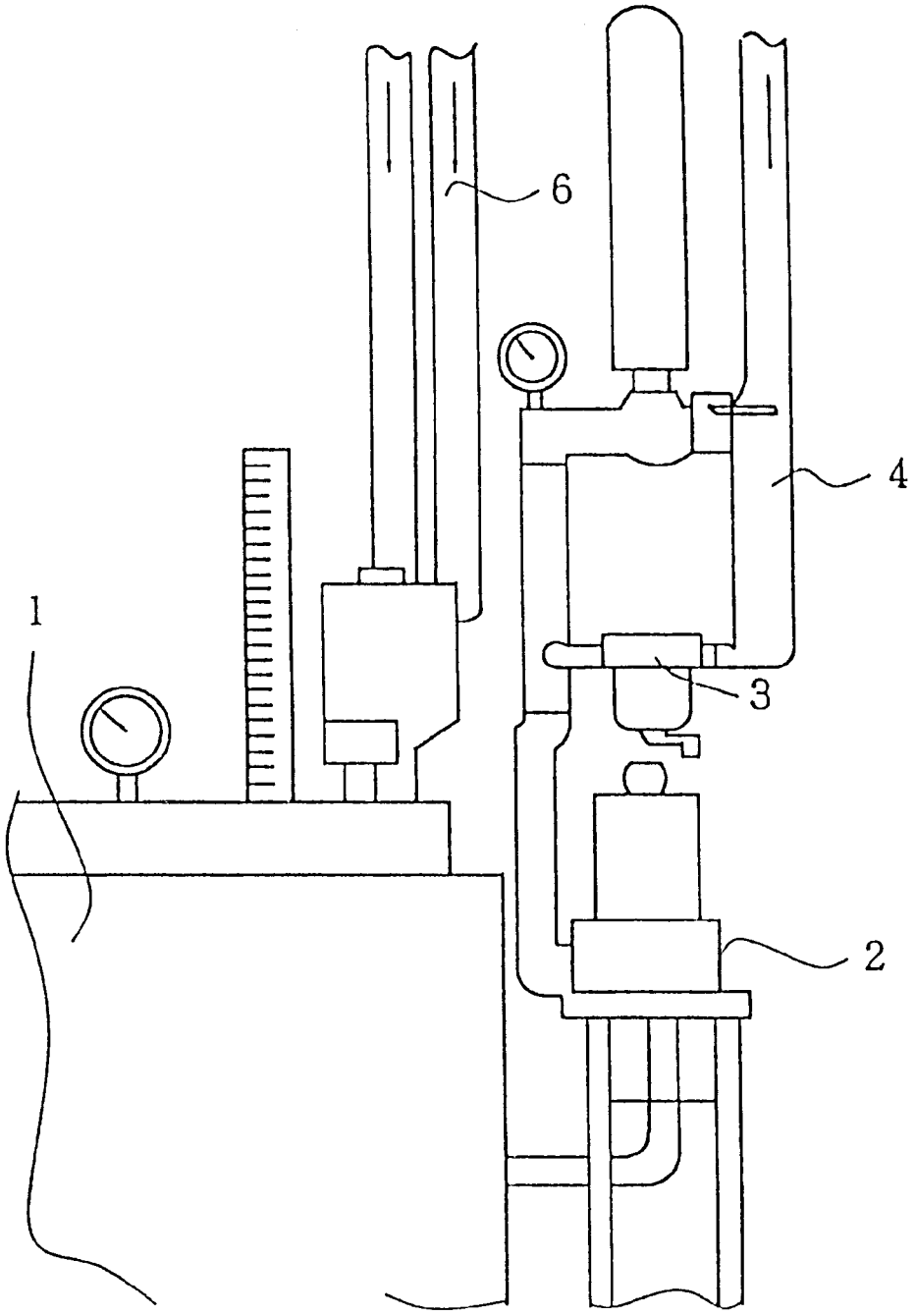
FIG. 1 shows in front view a part of the tank in the paint piping.

The cleaning agent and the cleaning process according to the present invention will be described below more specifically.

The cleaning agent according to this invention contains a pyrrolidone solvent, an amine solvent and a nonionic surfactant.

The pyrrolidone type solvent can be selected from 2-pyrrolidone and derivatives thereof such as N-methyl-2-pyrrolidone and 3-pyrrolidone. Among others, N-methyl-2-pyrrolidone is preferred because of high compatibility with the base resin of the coating.

As the amine solvent, one or more solvent is selected from dimethylacetamide (acetyl dimethylamine), ethanolamine, isopropanolamine and triethanolamine. When N-methyl-2-pyrrolidone is selected as the pyrrolidone solvent, dimethylacetamide is preferably selected as an essential amine solvent, and also at least one other solvent selected from ethanolamine, isopropanolamine and triethanolamine is preferably admixed thereto.

The nonionic surfactant may not be limited particularly so long as it is of nonionic type and can be selected from polyethylene glycol alkyl ethers, polyethylene glycol fatty acid esters, sorbitan fatty acid esters, fatty acid monoglycerides and others.

The cleaning agent according to this invention is based on a pyrrolidone solvent, and when N-methyl-2-pyrrolidone is selected as the pyrrolidone solvent, it is incorporated at a mixing ratio of 90 to 95 wt %. In this case, the mixing ratio of the amine solvent and that of the nonionic surfactant are suitably selected in the range of 5 to 10 wt % and in the range of 1 to 5 wt %, respectively.

When N-methyl-2-pyrrolidone is selected as the pyrrolidone solvent and dimethylacetamide is selected as the essential amine solvent, N-methyl-2-pyrrolidone and dimethylacetamide are preferably incorporated at a mixing ratio of 80 to 95 wt % in total, and other amine solvent and the nonionic surfactant are suitably selected in the range of 1 to 10 wt % and in the range of 1 to 5 wt %, respectively.

While the object material to be washed off by the cleaning agent according to the present invention is coating materials in general, the cleaning agent exhibits particularly high cleaning power against color base coating materials employed for coating automobiles and the like. The color base coating contains as a major component a polyester resin as a base with which a pigment is kneaded and also a melamine resin and an epoxy resin admixed thereto. The solubility parameter of the color base coating is about 11.

The cleaning agent of the present invention containing 80 to 95% by weight of N-methyl-2-pyrrolidone and dimethylacetamide, 1 to 10% by weight of other amine type solvents and 1 to 5% by weight of a nonionic surfactant has a solubility parameter of about 11.3, which is close to that of the color base coating and has high compatibility with it. Accordingly, the cleaning agent of the present invention has a great power of dissolving the color base coating.

The base polyester resin of the color base coating has the following formula:

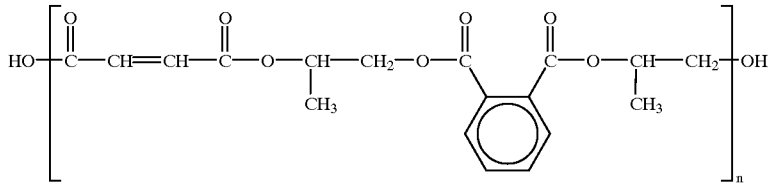

while the base N-methyl-2-pyrrolidone of the cleaning agent of the present invention has the following formula:

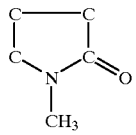

In these formulae, a carbon-oxygen double bond (C═O) is present in the monomer moiety of the polyester resin, while N-methyl-2-pyrrolidone also contains a C═O bond. Meanwhile, the bonds of monomers in the polyester resin are of ester bonds which are similar to the 5-membered ring of N-methyl-2-pyrrolidone. Accordingly, the polyester resin and N-methyl-2-pyrrolidone are of similar structures and have good compatibility with each other.

Next, the mechanism of removing a coating with the cleaning agent of the present invention will be described. Removal of the coating is achieved by an interaction of dissolution and lifting. Aggregates deposited in the paint piping are roughly divided into a sol form where the resin molecules are weakly bound with one another due to reduction of a diluting thinner and a gel form where the resin molecules are firmly bound to one another to form a coating film like a baked film.

As described above, the cleaning agent of the present invention has a solubility parameter similar to that of the resin in the coating, and the base N-methyl-2-pyrrolidone has a relatively similar structure to that of the resin. Accordingly, the cleaning agent of the present invention intrudes into the weak bonds of the resin particles of the sol-like coating aggregates to achieve dispersion of them in the form of smaller aggregates and dissolution thereof.

Meanwhile, the gel-like coating aggregates assuming the form of coating film contains innumerable pinholes. The reason why these pinholes are formed in the coating film is because the coating film has an undulated surface, since a coating constantly flows through the piping, and because the coating is stirred in the tank to include air or injection air is included in the coating.

The cleaning agent of the present invention can intrude through these pinholes into the gel-like resin aggregates assuming a form of coating film to lift it off from the wall surface of the piping.

As described above, the cleaning agent of the present invention exhibits a great dissolving power and a great penetrating power against coating materials and can remove successfully coating aggregates.

Dimethylacetamide employed in the cleaning agent of the present invention acts to enhance the above-described cleaning power of N-methyl-2-pyrrolidone. Ethanolamine, isopropanolamine and triethanolamine act to promote the dissolving power and penetrability of N-methyl-2-pyrrolidone, and further triethanolamine has a preserving action. The nonionic surfactant disperses these components homogeneously, and it also acts to envelope the lifted and dissolved coating therein and prevent it from being redeposited on the piping.

The pyrrolidone solvent, the amine solvent and the non-ionic surfactant described above are of low alkalinity and contain no halogen such as chlorine having high toxicity and high attacking properties, so that they are safe and are not causative of environmental disruption, and also they can be handled easily. Further, since the cleaning agent of the present invention belongs to the third petroleum water-soluble fluid, it has low flammability and can be handled easily.

The cleaning process according to the present invention includes a step of extracting a coating from the paint piping and a pre-washing step of circulating a cleaning thinner. In the pre-washing step, the coating remaining deposited in the paint piping is dissolved and removed. Subsequent to this pre-washing step, the cleaning agent of the present invention is circulated to carry out main washing, and thus the piping can be cleaned completely by the dissolving power and penetrability of the cleaning agent.

The main washing step is followed by a post-washing step of circulating a cleaning thinner to replace the cleaning agent of the present invention with it. Subsequently, a diluting thinner employed for diluting a coating material is circulated to remove the cleaning thinner so as to prevent defecting coating due to inclusion of the cleaning thinner from occurring.

In the cleaning process described above, these steps are carried out without disassembling the paint piping. The cleaning agent of the present invention has low attacking property and does not damage the attachments including branch pipes, regulators and valves. Accordingly, there is no need of disassembling the piping, removing the attachments and reassembling after completion of a cleaning, leading to reduction in the cleaning time. For example, cleaning of a cleaning capacity of 600 liters can be completed within 40 hours. Further, there is no need of wasteful replacement of attachments, they can be utilized effectively.

When the main washing step according to the present invention is to be carried out, compressed air may be supplied intermittently. The compressed air may be supplied, for example, for 5 to 10 seconds every two hours. The supply of compressed air accelerates penetration of the cleaning agent into coating aggregates and also increases the circulation speed, so that the cleaning effect can be increased.

The following examples are provided to describe in detail certain embodiments of the present invention.

EXAMPLES

The cleaning agent and process used in the following embodiments are as follows:

A cleaning agent was prepared according to the following formulation:

| | |
|---|---|
| N-methyl-2-pyrrolidone | 84 wt % |
| Dimethylacetamide | 10 wt % |
| Monoisopropanolamine | 3 wt % |
| Triethanolamine | 1 wt % |
| Surfactant | 2 wt % |

Figure 2:
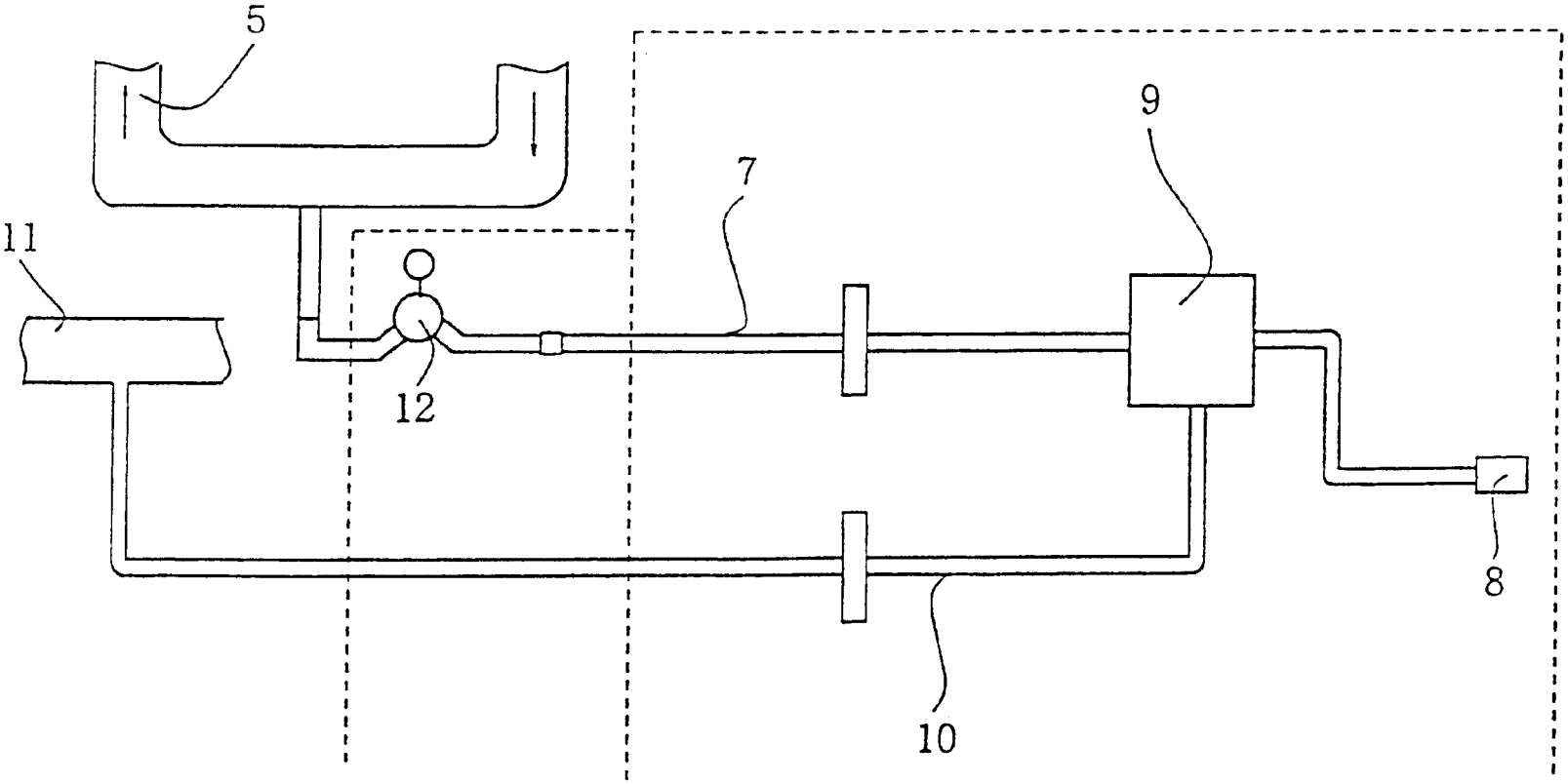
FIG. 2 shows in plan view the coating execution section in the paint piping.

A paint piping having a total volume of 600 liters and the structure shown in FIGS. 1 and 2 was cleaned using the thus prepared cleaning agent. Cleaning was carried out with the entire system including the tank, the main piping, the branch pipes, the regulators, the color change valves, etc. being connected as such.

First, the coating employed in the pipeline including the tank was extracted, and a general-use cleaning thinner was circulated through the pipeline. Subsequently, the cleaning thinner was extracted, and the cleaning agent was circulated. Air purge was performed by feeding compressed air during circulation of the cleaning agent for about 10 seconds every about two hours.

After circulation of the cleaning agent, the cleaning agent was extracted, and the general-use cleaning thinner was circulated. Then, the general-use cleaning thinner was extracted, and a coating diluting thinner was circulated to dilute and replace the cleaning thinner with it. Further, this diluting thinner was extracted to complete the cleaning process. Incidentally, the cleaning procedures using the cleaning agent was completed, with reference to drop in the permeability measurement result, on the 8th day in a first embodiment, and on the 5th day in second to fourth embodiments. The measurement carried out on the 17th day according to the fourth embodiment, as shown in Table 2, was directed to see the result of the cleaning.

First Embodiment

The results of piping cleaning test 1 are summarized as follows:

Period: 8 days

Piping system: Dead end

Coating type: Intermediate coat

Coating method:Normal circulation with air purge

The washing of the cleaning agent was passed through a 100 mesh filter and a 200 mesh filter respectively to measure the amounts of residues.

| Schedule: | 3th day | 4th day | 5th day | 8th day |
|---|---|---|---|---|
| Weight of residue (g): | 1.79 | 0.51 | 0.09 | 8.34 |
| Mesh size: | 100 | 200 | 200 | 200 |

The washing of the cleaning agent was recovered to measure transmittance of it.

Instrument employed:Double-beam spectro-photometer Model U-2000A

Dilution rate: Measured for stock solution

| Schedule: | 1st day | 2nd day | 3rd day | 4th day | 5th day | 8th day |
|---|---|---|---|---|---|---|
| Trans-mittance (%): | 66.48 | 23.61 | 12.82 | 12.23 | 11.13 | 7.54 |

Second Embodiment

The results of piping cleaning test 2 are summarized as follows:

Period: 5 days

Piping system: Dead end

Coating type: Intermediate coat

Coating method:Normal circulation with air purge

The washing of the cleaning agent was recovered to measure transmittance of it.

Instrument employed:Double-beam spectro-photometer Model U-2000A

Dilution rate:Measured for 200-fold diluted solution

| Schedule: | 1st day | 2nd day | 3rd day | 4th day | 5th day |
|---|---|---|---|---|---|
| Transmittance (%): | 100 | 38.7 | 29.3 | 21.3 | 24.6 |

Third Embodiment

The results of piping cleaning test 3 are summarized as follows:

Period: 12 days

Piping system: Dead end

Coating type: Top coat

Coating method:Normal circulation with air purge

The washing of the cleaning agent was recovered to measure transmittance of it.

Instrument employed: Double-beam spectro-photometer Model U-2000A

Dilution rate: Measured for100-fold diluted solution

| Schedule: | 1st day | 2nd day | 3rd day | 4th day | 5th day |
|---|---|---|---|---|---|
| Transmittance (%): | 100 | 79.2 | 28.9 | 20.8 | 21.7 |

Fourth Embodiment

The results of piping cleaning test 1 are summarized as follows:

Period: 19 days

Piping system: Third system

Coating type: Top coat, solid

Coating method:Normal circulation with air purge

The washing of the cleaning agent was recovered to measure transmittance of it.

Instrument employed:Double-beam spectro-photometer Model U-2000A

Dilution rate:Measured for 30-fold diluted solution

| Schedule: | 1st day | 2nd day | 3rd day | 4th day | 5th day | 17th day | 18th day | 19th day |
|---|---|---|---|---|---|---|---|---|
| Transmittance (%): | 80.8 | 40.4 | 38.9 | 29.7 | 28.2 | 21.6 | 20.2 | 21.0 |

The types of the coating to be washed off, presence or absence of air purge and the dilution rate of the washings for transmittance measurement in the first to fourth embodiments are summarized in Table 1. The coating types are indicated according to the categories employed for coating automobiles.

TABLE 1

| | Coating type | Air purge | Dilution rate |
|---|---|---|---|
| First embodiment | Coating for intermediate coat | Yes | Stock solution |
| Second embodiment | Coating for intermediate coat | Yes | 200 fold |
| Third embodiment | Coating for top coat | Yes | 100 fold |
| Fourth embodiment | Solid coating for top coat | Yes | 30 fold |

The results of transmittance (%) measured for the cleaning agents of the first to third embodiments under washing are shown in Table 2. The dilution rates are as shown in Table 1. Measurements of transmittance were all carried out using a double-beam spectrophotometer (Model U-2000A, trade name, Hitachi, Ltd.). In any of the embodiments, transmittance was extremely dropped after about 2 days since cleaning was started, showing that the effect of cleaning appears in a short time.

TABLE 2

| | 1st day | 2nd day | 3rd day | 4th day | 5th day | 8th day | 17th day |
|---|---|---|---|---|---|---|---|
| First embodiment | 66.48 | 23.61 | 12.82 | 12.23 | 11.13 | 7.54 | — |
| Second embodiment | 100 | 38.7 | 29.3 | 21.3 | 24.6 | — | — |
| Third embodiment | 100 | 79.2 | 28.9 | 20.8 | 21.7 | — | — |
| Fourth embodiment | 80.8 | 40.4 | 38.9 | 29.7 | 28.2 | — | 21.6 |

Table 3 shows the amount of residues filtered out from a portion of the washing of the cleaning agent in the first embodiment. The amounts of residues each measured in 100 g of a sample collected from the washing are shown.

TABLE 3

| | 3rd day | 4th day | 5th day |
|---|---|---|---|
| Filter mesh size | #100 | #200 | #200 |
| Weight of residue (g) | 1.79 | 0.51 | 0.09 |

As has been described heretofore, according to the present invention, the reducing, neutralizing and preserving treatments to be carried out after removal of coating aggregates in the prior art process can be omitted, and thus the number of operation steps can be reduced. Further, since the cleaning agent of the present invention is based on the pyrrolidone solvent and scarcely affects metals, cleaning of regulators and color change valves can be carried out without disassembling the pipeline. In addition, the cleaning agent of the present invention is neither a strong inorganic acid nor a strong alkali, it has low toxicity and is safe to human bodies and environment.

Although some embodiments of the present invention have been described herein, it, should be apparent to those skilled in the art that the present invention may be embodied in many other specific forms without departing from the spirit or scope of the invention. Therefore, the present embodiments are to be considered as illustrative and not restrictive, and the invention is not to be limited to the details given herein, but may be modified within the scope of the appended claims.

What is claimed is:

1. A cleaning agent for paint piping comprising (1) 84 to 95% by weight of a pyrrolidone solvent, (2) dimethylacetamide and at least one other amine solvent and (3) a nonionic surfactant.

2. The cleaning agent for paint piping according to claim 1, wherein the pyrrolidone solvent is N-methyl-2-pyrrolidone.

3. The cleaning agent for paint piping according to claim 1, wherein at least one other amine solvent is selected from ethanolamine, isopropanolamine and triethanolamine.

4. The cleaning agent for paint piping according to claim 1, wherein the pyrrolidone solvent is N-methyl-2-pyrrolidone, and at least one other amine solvent is selected from ethanolamine, isopropanolamine and triethanolamine.

5. The cleaning agent for paint piping according to claim 4, comprising 80 to 95% by weight of N-methyl-2-pyrrolidone and dimethylacetamide in total, 1 to 10% by weight of at least one other amine solvent selected from ethanolamine, isopropanolamine and triethanolamine, and 1 to 5% by weight of the nonionic surfactant.

6. A process for cleaning paint piping, comprising:

extracting a coating material employed for coating from a paint piping;

circulating a thinner through the paint piping to dilute a coating;

circulating the cleaning agent as set forth in any one of claims 1 to 5 through the paint piping;

circulating a cleaning thinner through the paint piping; and circulating a diluting thinner through the paint piping to dilute the coating material and replace the cleaning thinner in the paint piping.

7. The process for cleaning paint piping according to claim 6, further comprising supplying intermittently compressed air into the paint piping during circulation of the cleaning agent.

8. A process for cleaning paint piping, comprising:

circulating a thinner through the paint piping to dilute a coating;

circulating the cleaning agent as set forth in any one of claims 1 to 5 through the paint piping;

circulating a cleaning thinner through the paint piping; and circulating a diluting thinner through the paint piping to dilute the coating material and replace the cleaning thinner in the paint piping.

9. The process for cleaning paint piping according to claim 8, further comprising supplying intermittently compressed air into the paint piping during circulation of the cleaning agent.

* * * * *